US011388990B1

(12) United States Patent
Watkins

(10) Patent No.: US 11,388,990 B1
(45) Date of Patent: Jul. 19, 2022

(54) ADJUSTABLE MULTIDIMENSIONAL JIGSAW PUZZLE TABLE

(71) Applicant: Carl J Watkins, Eugene, OR (US)

(72) Inventor: Carl J Watkins, Eugene, OR (US)

( * ) Notice: Subject to any disclaimer, the term of this patent is extended or adjusted under 35 U.S.C. 154(b) by 0 days.

(21) Appl. No.: 17/573,650

(22) Filed: Jan. 12, 2022

(51) Int. Cl.

| | |
|---|---|
| ***A47B 13/08*** | (2006.01) |
| ***A63F 9/10*** | (2006.01) |
| ***A47B 9/04*** | (2006.01) |
| ***A47B 91/00*** | (2006.01) |
| ***A47B 95/00*** | (2006.01) |
| ***A47B 37/00*** | (2006.01) |
| ***A47B 11/00*** | (2006.01) |

(52) U.S. Cl.
CPC ..... *A47B 13/081* (2013.01); *A47B 9/04* (2013.01); *A47B 11/00* (2013.01); *A47B 13/086* (2013.01); *A47B 37/00* (2013.01); *A47B 91/002* (2013.01); *A47B 95/00* (2013.01); *A63F 9/1044* (2013.01); *A47B 2200/0001* (2013.01); *A47B 2200/0036* (2013.01); *A47B 2200/0043* (2013.01); *A47B 2200/0051* (2013.01)

(58) Field of Classification Search
CPC ..... A47B 13/081; A47B 13/086; A47B 9/04; A47B 11/00; A47B 37/00; A47B 91/002; A47B 95/00; A47B 2200/0001; A47B 2200/0021; A47B 2200/0022; A47B 2200/0023; A47B 2200/0025; A47B 2200/0036; A47B 2200/0043; A47B 2200/0051; A47B 13/023; A47B 2013/024; A47B 2013/025; A63F 9/1044
See application file for complete search history.

(56) References Cited

U.S. PATENT DOCUMENTS

| | | | | |
|---|---|---|---|---|
| 5,549,052 | A * | 8/1996 | Hoffman | A47B 9/00 108/138 |
| 6,694,891 | B1 * | 2/2004 | Lai | A47B 19/08 248/150 |
| 2007/0045493 | A1 * | 3/2007 | Somji | F16M 13/00 248/229.14 |
| 2007/0131149 | A1 * | 6/2007 | Mayben | A47B 57/00 108/97 |
| 2010/0251941 | A1 * | 10/2010 | Muirhead | G06F 21/554 108/51.11 |

* cited by examiner

*Primary Examiner* — Matthew W Ing

(57) ABSTRACT

A table dedicated to facilitating the comfort, efficacy, and enjoyment of assembling a jigsaw puzzle which may be adjusted for height, tabletop tilt angle and tabletop rotation, and location. The table has a specialized surface to hold the puzzle pieces in place, an accessory bracket to add accessories such as trays, puzzle box top holder, magnifying glass and other implements to enhance the assembly experience. Trays for sorting puzzle pieces may be attached and detached from a specialized bracket mounted on a support structure. The tabletop may be positioned high enough to be used while standing upright. The use of this table apparatus for other activities is anticipated.

4 Claims, 6 Drawing Sheets

ADJUSTABLE MULTIDIMENSIONAL JIGSAW PUZZLE TABLE

BACKGROUND

This invention relates to activity tables and more particularly to a table specifically designed for the assembly of jigsaw puzzles.

The jigsaw puzzle, and its assembly, has heretofore not been given the respect it richly deserves. Millions of people on every continent spend hours every day assembling jigsaw puzzles which come in endless varieties and configurations. Yet this universally popular pastime has not been deemed important enough to justify an assembly table designed specifically for jigsaw puzzles. The prior art for tables designed to improve the experience of the assembly of jigsaw puzzles has been focused on relatively minor assistance for the puzzle assembler. Improvements have been minimal in recent years and have consisted mostly of refinements of much earlier concepts. U.S. Pat. No. 8,235,207/2012 B2 discloses a puzzle storage apparatus not significantly different in functionality from U.S. Pat. No. 1,987,496/1935 or U.S. Pat. No. 4,865,325/1989. Many of these patents disclose jigsaw puzzle tables which provide for ways to facilitate the completion of a puzzle by organizing puzzle pieces in drawers, trays, and layered compartments. A primary objective of others of these patents, such as U.S. Pat. No. 4,436,307/1984, is to make it possible to move the puzzle, which may take days or weeks to finish, out of the way of other activities requiring the horizontal surface. They provide a means to remove a partially completed puzzle from the table on which it is being assembled and transport it elsewhere without disassembling the puzzle. Some other patents, such as U.S. Pat. No. 6,928,932/2005 B1, focus on making it easier to actually assemble the puzzle by providing a variety of tilting means so that a seated person may see and reach more of the puzzle. The way most puzzlers now work on their puzzles is by sitting down and leaning over a card table, coffee table, or dining room table. They often have to stand up and walk around the puzzle to get a better view of the pieces, and then lean over for a closer look. The longer they lean over the more that fatigue sets in, especially in the shoulders and lower back. Tilting the table up helps but does not eliminate the need to get up and move around the puzzle, especially with larger puzzles of five hundred to one thousand pieces or more. Tables that tilt typically move the assembler further from the puzzle due to the fact the puzzles often are placed upon an existing table, which prevents them from extending below that support surface. This also often makes these tables impractical for larger puzzles. Tables with rotating mechanisms make the edges of the larger puzzles more easily accessible, but do not make the detail of the pieces in the center of the puzzle more easily viewable or include drawers or compartments for organizing pieces and sub-assemblies. None of these tables combines more than one or two helpful features into one table. No table until now has been dedicated to optimizing every aspect of the experience of assembling a jigsaw puzzle.

Mechanisms that provide a combination of adjustability for height or lift, tilt and rotation have been in existence for many years. Some examples are camera tripods, industrial robotics or automation systems, and swiveling easels for painters. Each of these involves specialization appropriate for the task at hand. The multi-dimensional adjustable jigsaw puzzle table of this invention takes the same approach in creating a synergistic specialized table for jigsaw puzzle assemblers.

SUMMARY OF THE INVENTION

It is the aim of the present invention to provide a table dedicated to the convenient, expeditious and joyful assembly of jigsaw puzzles. Rather than using a temporary location, such as a dinner table or card table, to put the puzzle together, assemblers now have a table specifically designed for their use with features that make assembling the puzzle easier and more comfortable. This singular approach employs a combination of features to provide several dimensions of adjustability so that the assembler is comfortable, and all parts of the puzzle and its pieces are easily viewable and quickly accessible. It is a further objective of this puzzle table to enable a user to stand without leaning while assembling the puzzle—now recognized as an ergonomic health benefit. It is also possible for the adjustable multi-dimensional apparatus of this invention to be used for other activities such as assembling models, art projects or other types of games or puzzles.

To achieve these objectives, the jigsaw puzzle table apparatus of this invention provides a relatively large tabletop puzzle assembly area which has a tilt mechanism that allows the assembler to tilt the table down in front, providing a better view of the puzzle and making more of the puzzle reachable. Combined with this is a rotating mechanism that allows the tabletop to be rotated in either direction so that the assembler can easily move to any part of the puzzle for inspection, manipulation, and placement. This combination of tilting and rotating the tabletop makes it possible for the tabletop to be larger than a typical card table and still be easily viewable and reachable while remaining seated. The surface of the puzzle table apparatus is covered with a specialized material with characteristics that enhance the manipulation of the puzzle pieces, specifically holding the pieces in place when the tabletop is being tilted and rotated. The puzzle assembler sits or stands at the table viewing almost the entire puzzle up close and swiveling the table to inspect and access any part of the puzzle. The table has a plurality of lockable wheels or casters, allowing the puzzle table to be easily moved into a desired position and anchored. The tabletop can be easily raised and lowered with the assistance of a pneumatic cylinder located within a structural support assemblage and activated by a release mechanism operated either by the hand or the foot. At the lowest height, the tabletop is suitably positioned for a puzzle assembler sitting in their favorite chair. In the higher positions, the tabletop is appropriate for a person who prefers to stand while assembling. The table user may stand and work on the puzzle for a while and then easily lower the table to a sitting position when they prefer to sit. Previous to this invention, people who preferred to stand when assembling a puzzle typically needed to lean over a regular height table for extended periods of time, causing physical discomfort and fatigue. Many puzzle assemblers like to have trays or drawers nearby to collect and organize puzzle pieces into related groups. To address this requirement, an accessory bracket may be added to allow for accessories. One main accessory may be a tray and supporting assembly providing one or more trays where puzzle pieces may be stored, collected, or assembled. The trays are detachably connected to a flexible arm by a bracket having a hooking means configured to match the lip or shape of the tray edge. Multiple trays may be attached to the flexible arm with one bracket so that the assembler may sort and collect a wide variety of pieces in separate trays. Each tray may be detached and moved around or viewed more closely and then re-attached as desired. Other accessories such as lights, magnifying glass, puzzle box top holder, electric power outlet, cup holders, phone holders, or television remote control holders may be attached to the bracket as the assembler desires. If an alternative embodiment of this adjustable puzzle table were to include remotely controlled adjustment means, the control would be stored on this accessory bracket. These attachments may automatically adjust their orientation as the tabletop is tilted.

A further embodiment of this puzzle table apparatus (not shown) comprises a support structure that cantilevers the tabletop over a bed, enabling a bedridden assembler to enjoy putting a larger puzzle together as capably as if in a chair. This is currently not possible for many ardent puzzlers.

By combining all of these beneficial features for jigsaw puzzle assembly into a single puzzle table, the apparatus of this invention offers the puzzle assembler a new level of comfort, efficacy, and enjoyment.

BRIEF DESCRIPTION OF THE DRAWINGS

FIG. 1 is a perspective view of the jigsaw table apparatus in a lowered position with the front of the tabletop tilted about 15 degrees downward from horizontal and rotated approximately 15 degrees clockwise from square on.

DETAILED DESCRIPTION OF THE DRAWINGS

Figure 1:
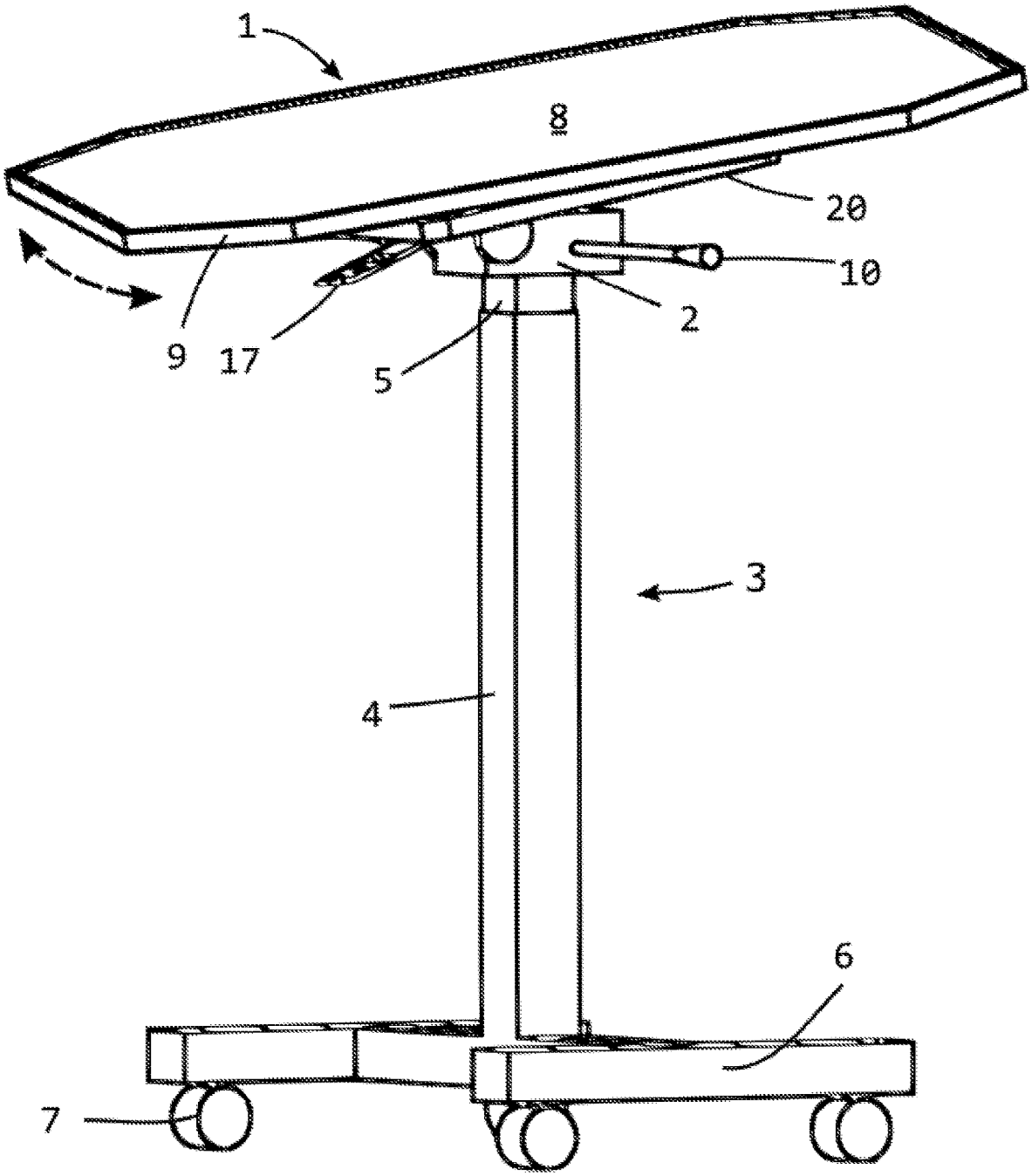

Referring now to the drawings, in FIG. 1 a preferred embodiment of the jigsaw puzzle table apparatus of this invention is shown with the tabletop 1 being tilted downward in front by fifteen degrees and rotated fifteen degrees counter-clockwise from a straight-on position. The height of the tabletop 1 from the floor is in a relatively low position appropriate for a user sitting in a normal height chair. This is a common arrangement of the features of this puzzle table apparatus as it provides for easy viewing of a large portion of a jigsaw puzzle and easy access to any portion of the puzzle by rotating the tabletop 1 in either direction, all while the assembler remains comfortably seated. The tabletop 1 can be adjusted to a higher or lower position by means of the adjustment mechanism housing 2 by raising the height adjustment control handle 10. The tabletop 1 can be adjusted to a different tilt angle by means of the tilt mechanism (visible in FIG. 3) using the tilt adjustment handle (visible is FIG. 2 and FIG. 3). The height adjustment control handle 10 and the tilt control handle (13 in FIG. 2) may be relocated to other places on the structural support assemblage 3 convenient for either the hands or feet. The tabletop 1 can be rotated by gripping the edge trim 9 and moving the tabletop left or right. The tabletop 1 may be allowed to rotate freely, or slowed with a frictional impediment, or it may be locked in a particular position by multiple types of locking mechanisms (not shown). The adjustment mechanism housing 2 is supported by the structural support assemblage 3 consisting of the outer or lower tube 4 which is slidably or telescopically connected to the inner or upper tube 5. A pneumatic cylinder (not shown) resides within the structural support assemblage 3 and provides upward force to raise the tabletop 1. When the height mechanism adjustment control handle 10 is lifted vertically and downward pressure is applied to the tabletop 1, it can be lowered. The base support assemblage 3 is connected to the bottom frame 6 which is supported on rolling mechanisms 7. The entire apparatus of this invention can be rolled into the desired position and the wheels or casters of the rolling mechanism 7 can be locked in place. A surface cover 8 is adhesively attached to the tabletop 1 to provide an appropriate surface for the intended use of the puzzle table apparatus. For the assembly of a jigsaw puzzle, a fabric or material that has a frictional property, such as felt, will hold the puzzle pieces in place even as the tabletop is tilted. Many other types of materials may be used which have an appropriate frictional aspect such that the puzzle pieces do not slide around or off the tabletop 1. An accessory bracket 17 attached to sub-table 20 may be provided to attach accessories such as trays for collecting puzzle pieces, or other implements as desired by the table user. A further embodiment (not shown) of the tilting and rotating tabletop of this jigsaw puzzle table apparatus may be configured without the structural support assembly 3 and base frame 6. This alternative embodiment may be independently placed on any type of table, countertop, desk, tripod, or podium and still fall within the scope of the adjustable tilting and rotating jigsaw puzzle table of this invention.

Figure 2:
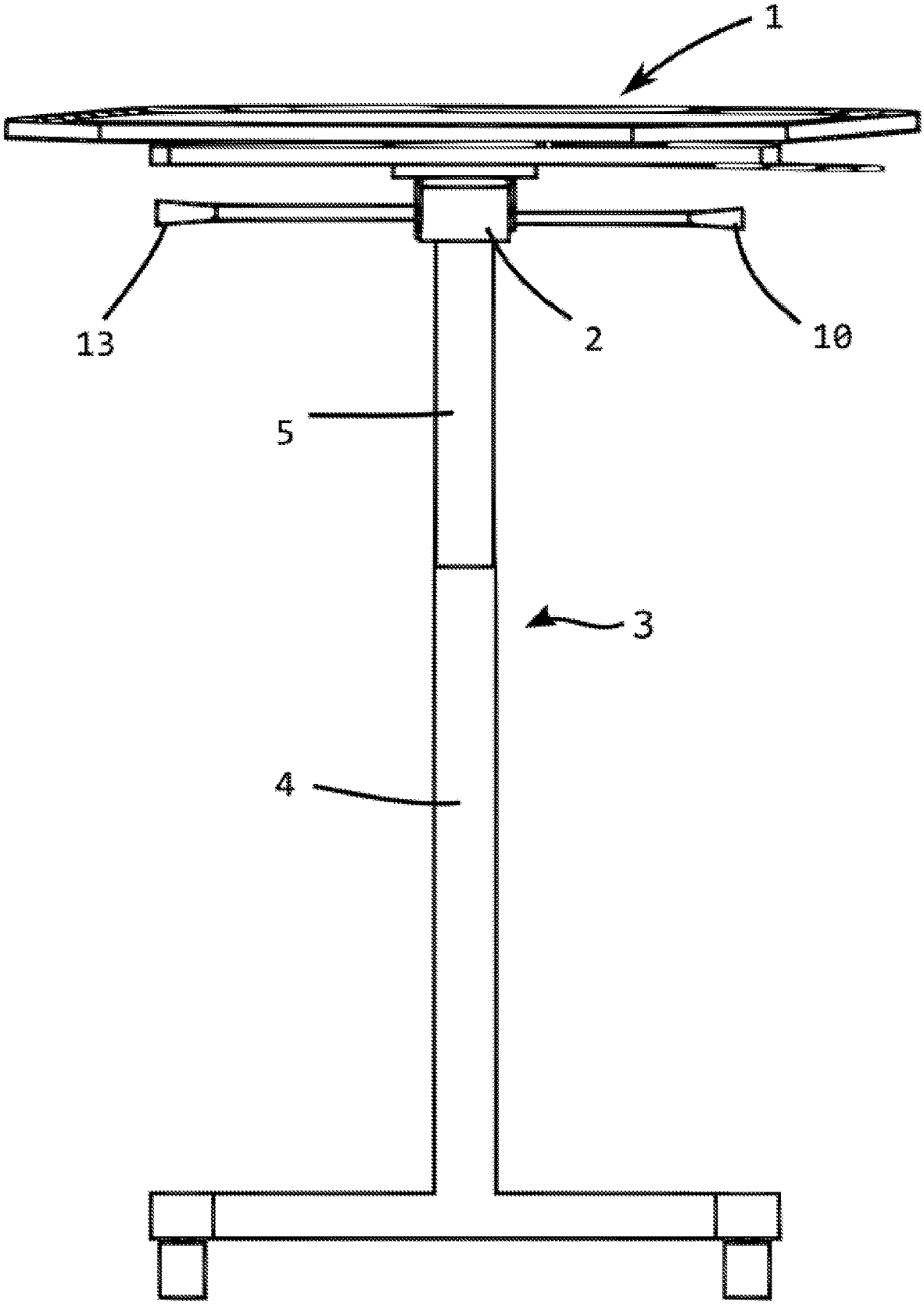
FIG. 2 is a front view of the jigsaw table apparatus in a raised position with the tabletop tilted slightly downward in front.

Referring to FIG. 2, the jigsaw puzzle table is shown with the tabletop 1 tilted slightly downward in front while in a high or raised position relative to the floor, which is appropriate for a standing puzzle assembler. The adjustment mechanism housing 2 is supported by inner tube 5 within outer tube 4 of the base support assembly 3. The height adjustment control handle 10 and the tilt adjustment control handle 13 are actuated by lifting them vertically in this embodiment, but many other methods of controlling these adjustment mechanisms are possible, and may include other mechanical methods, electrical actuators, or remote controls. The position of these controls on the apparatus may also be relocated to other convenient locations.

Figure 3:
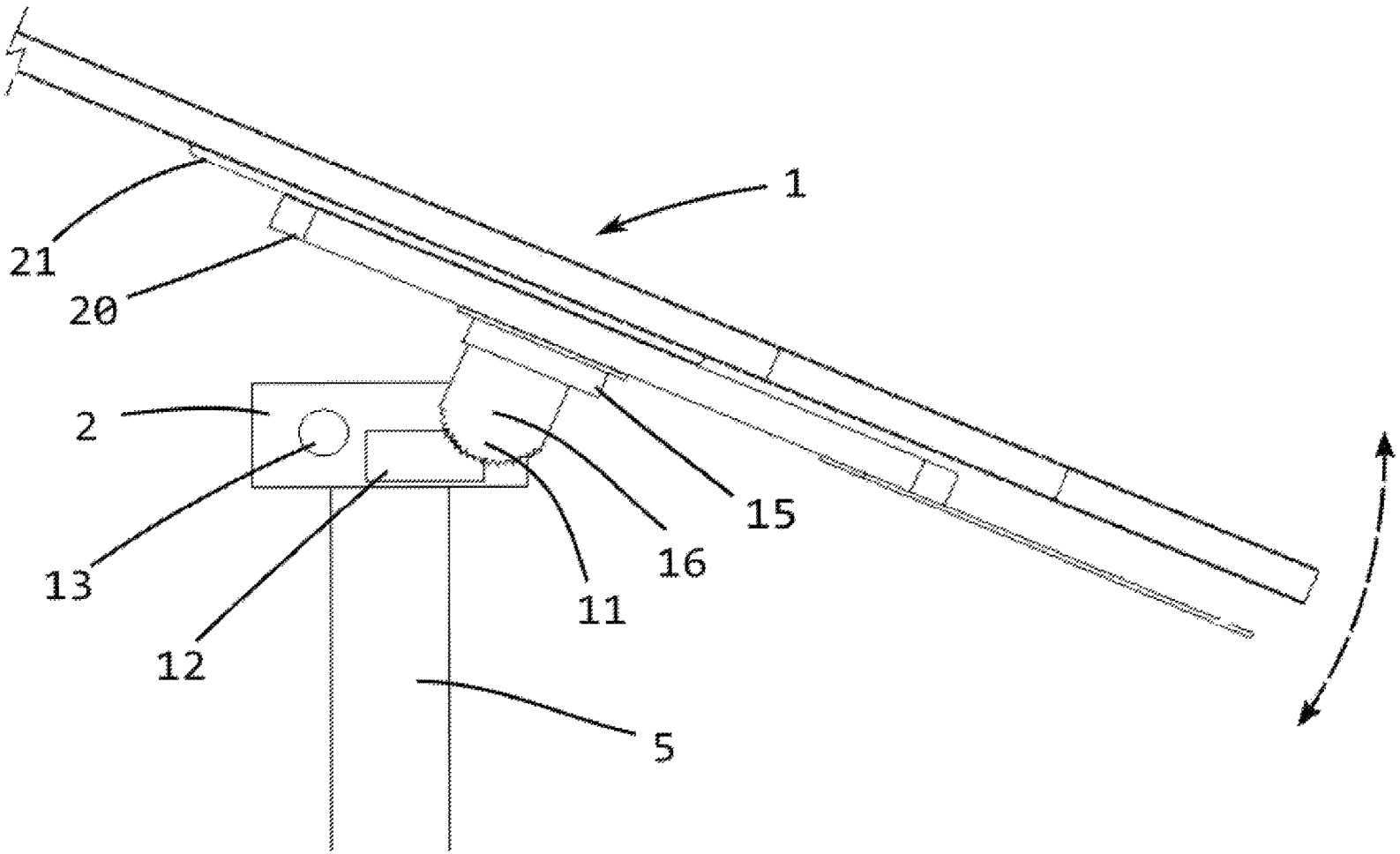
FIG. 3 is a side view of the adjustment mechanism housing of this invention.

Referring to FIG. 3 the tilt mechanism assemblage is comprised of a toothed gear flange 11 and a correspondingly toothed locking bracket 12 which is connected within the adjustment mechanism housing 2 to the tilt adjustment control handle 13. When the tilt adjustment control handle 13 is lifted vertically, the toothed locking bracket 12 moves away from the toothed gear flange 11 which supports the tilt bracket 15. This allows the toothed gear bracket 11 to rotate around axis point 16 causing the tilt bracket 15 to move from one tilted position to another radially. The sub-table 20 consequently tilts along with the tilt bracket 15. Attached to the sub-table 20 is the rotational bearing 21 which attaches to and causes the tabletop 1 to move from one correspondingly tilted position to another.

Figure 4:
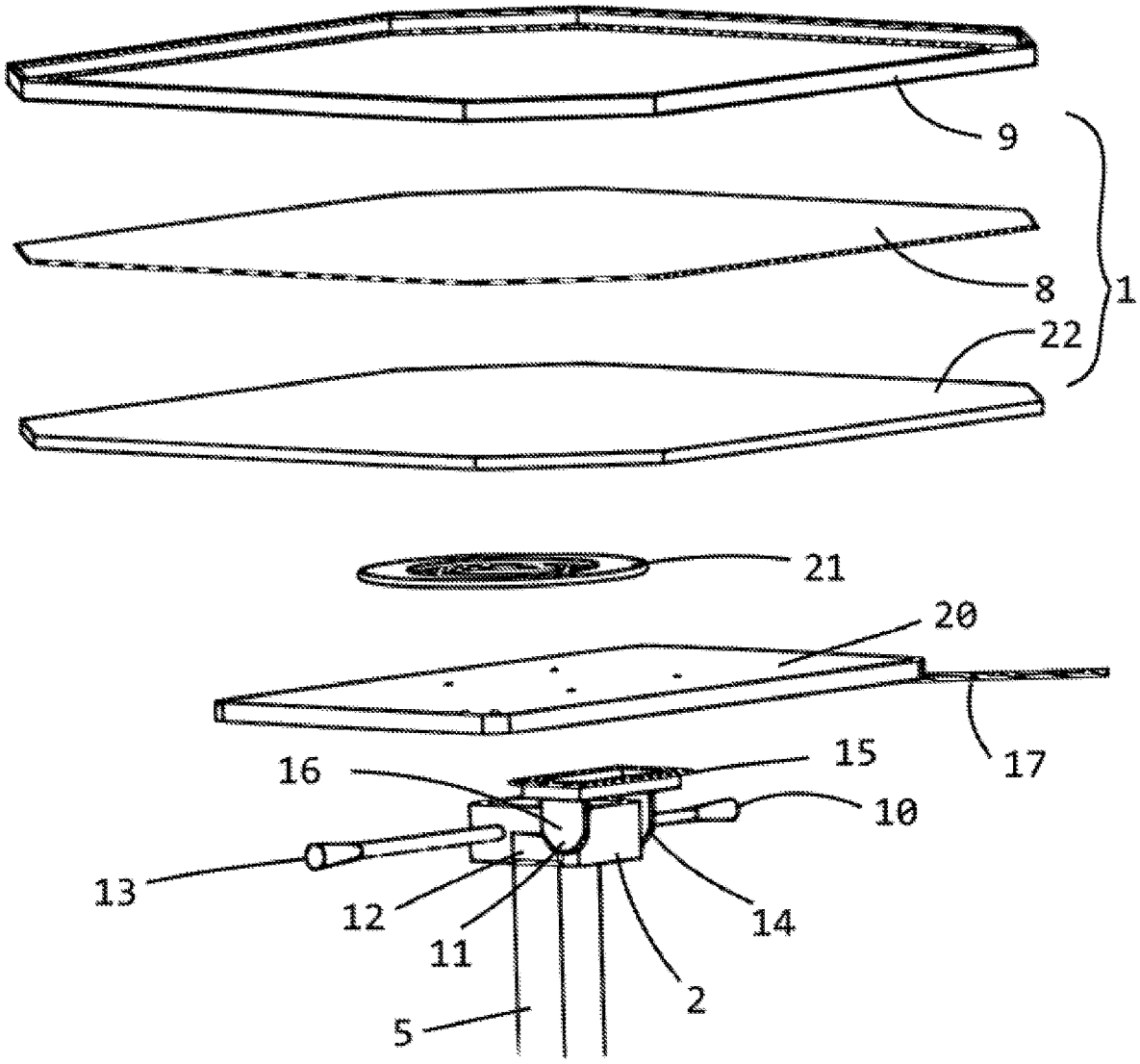
FIG. 4 is an exploded view of the adjustable jigsaw table apparatus of this invention.

FIG. 4 shows the arrangement of the components that provide the combined adjustability of the tabletop 1, including the rotation means 21 which connects to the underside of a surface board 22 of the tabletop 1 and the upper side of the sub-table 20. The rotation means in this embodiment is a lazy-susan bearing, but other types of bearing or swivel configurations may be employed, as well as alternative rotational methods such as electric motors or other swiveling devices. The sub-table 20 is connected to the tilt bracket 15 which connects to the adjustment mechanism housing 2 by a toothed gear flange 11 and a support flange 14 which rotate around a pivot axis point 16. Many tilting mechanisms may be employed to accomplish this tilting function, such as an arching slot with locking bolt, pin, or wingnut, or an arching sequence of holes which may be pinned in place. These may be mechanically or electronically activated. One advantage of the preferred embodiment described is that it enables the tabletop 1 to move from a horizontal position easily and gradually to a vertical position, which provides efficient storage against a wall. Additionally, there are many alternative configurations for the tilt bracket 15 which connects to the sub-table 20, which itself may have many alternative shapes, sizes, and materials. The sub-table 20 may even be eliminated by combining the tilt mechanism and the rotation mechanism into one unit. There are also many alternative mechanisms for adjusting the height of the tabletop 1 other than the pneumatic cylinder (not shown) of this embodiment, such as manually lifting or lowering the table and locking it at the desired height with a threaded tightening screw mechanism or by a pin with graduated holes, both of which would hold the tabletop in a desired position, but which are more cumbersome for the user. Other mechanisms are possible and might include a motorized rack and pinion gear or a motorized gear and ratchet system. It may also be possible to provide more than one adjustable support column in multiple configurations. The surface cover 8 is adhesively attached to the surface board 22 to provide a frictional aspect to the tabletop 1. The surface board 22 may be made of wood or another wood-like rigid material. The trim 9 surrounding the surface board 22 may be made of wood, plastic, rubber, or metal and may extend above the surface cover 8 to keep puzzle pieces from sliding or falling off the table when it is tilted. It may also extend below the surface board 22 to provide a gripping means when rotating the table left or right. An accessory bracket 17 may be fixably attached to the sub-table 20 to provide a means to attach various accessories, such as sorting trays, to the jigsaw puzzle table to enhance the user's experience.

Figure 5:
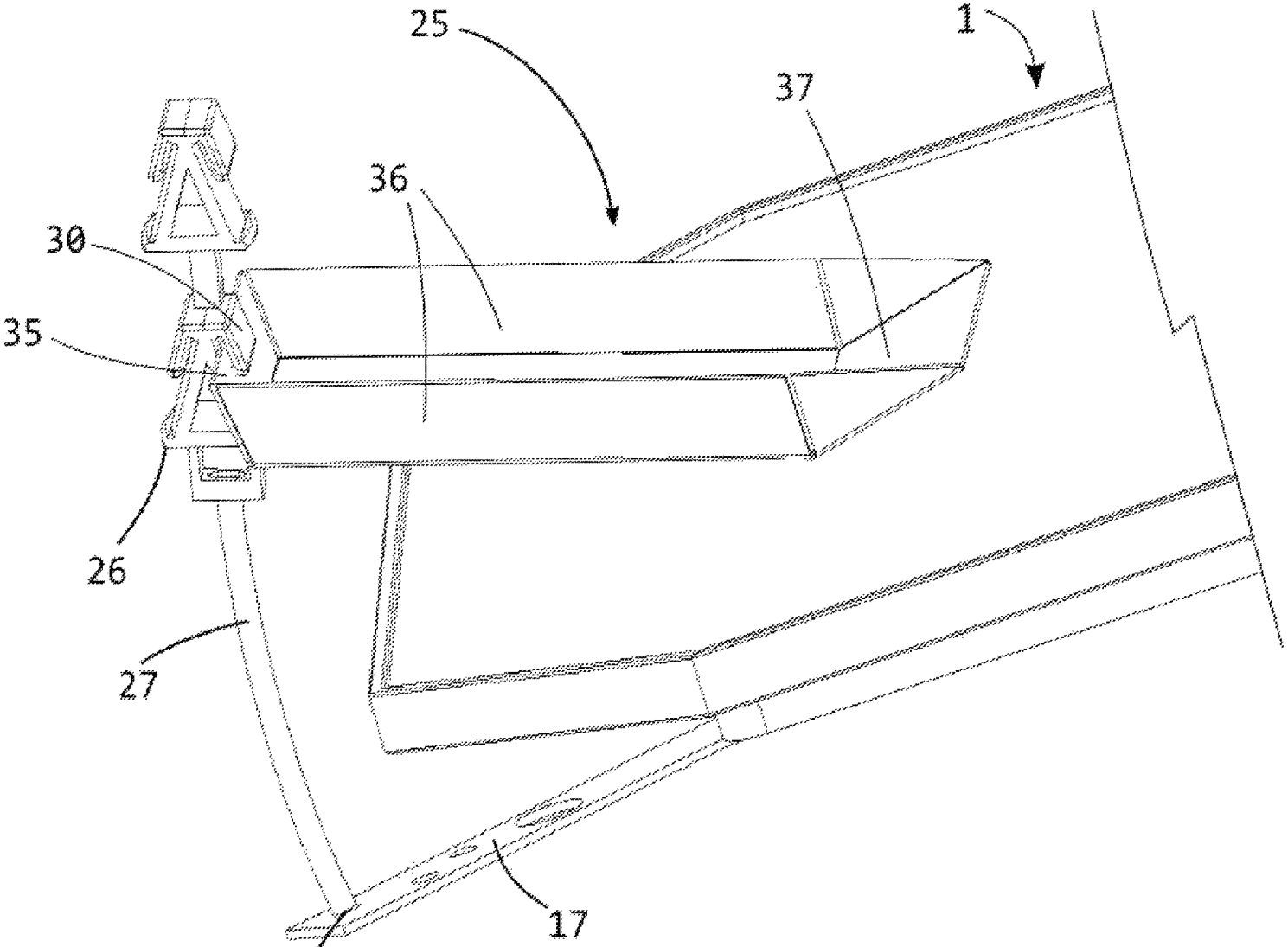
FIG. 5 is a perspective view of the jigsaw table apparatus showing the accessory bracket and the adjustable tray assembly attached thereto.

FIG. 5 shows a detachable tray 25 and a support apparatus consisting of a specially configured bracket 26 and a support 27. Jigsaw puzzle assemblers frequently use trays to collect and categorize pieces for sub-assembly and organization. The tray apparatus support 27 may be attached to the accessory bracket 17 with a threaded shaft through an attachment hole 28 in the attachment bracket 17. The attachment bracket 26 is especially designed to interface with the shape of the edge of the tray 25 such that it can be attached and detached easily when the puzzle assembler wants to have access to the collected pieces. The tray(s) 25 may have variously configured edges with corresponding configurations of the attachment bracket 26. In this preferred embodiment, a back side 35 is made of thick paper with a flexibility such that it can slide into the slot created by bracket flange 30. The sides 36 of the tray 25 are tilted slightly outward at their tops to facilitate easy stacking, but the sides may also be vertical. The front side 37 of the tray is tilted further down so that puzzle pieces collected in the tray 25 can be easily slid out of the tray 25. This is particularly helpful in some or all of the puzzle pieces in the tray 25 have been attached together into a sub-assembly. The support 27 in this embodiment is flexible and adjustable and is known as a gooseneck arm, but many other support means could be used to support the attachment bracket 26 and trays 25, depending on the application of use for the detachable tray and bracket apparatus. Trays 25 may be made of metal, wood, cardboard, paper, plastic, or any other flexibly rigid material. As the tabletop tilt angle is adjusted, the position of the trays will have to compensate in order to keep the trays level. Additionally, individual puzzle assemblers will want to locate the trays in their preferred position. Thus, the support structure in this embodiment is flexible and adjustable. In a further embodiment of detachable trays and support apparatus (not shown) it may be used for other purposes in other applications in which the trays may be used to store and access parts, tools, materials, or other items as desired. Other types of accessories may be attached to the accessory bracket 17 in similar fashion.

Figure 6:
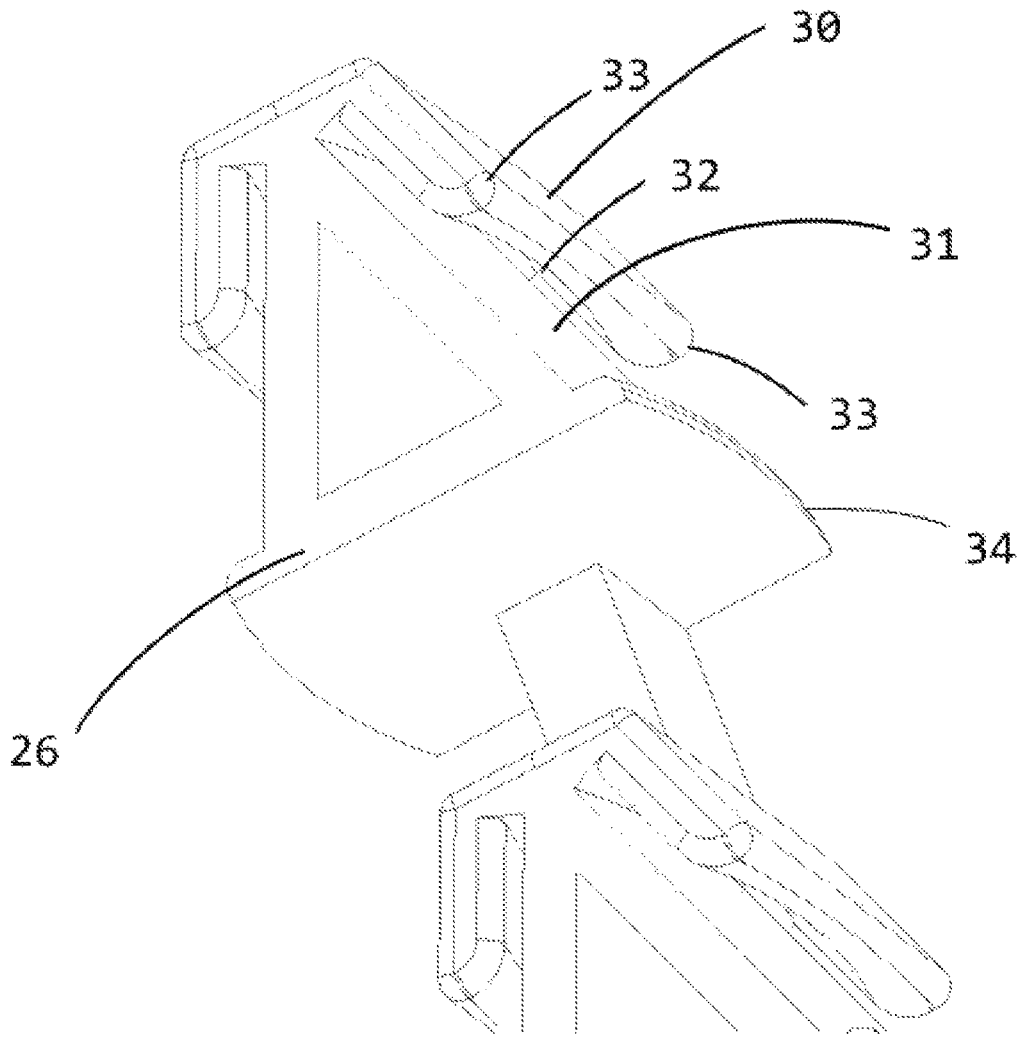
FIG. 6 is a perspective view of the tray attachment bracket.

FIG. 6 shows the preferred embodiment of attachment bracket 26 which enable it to firmly hold the puzzle piece tray 25. Bracket 26 has an outer flange 30 and a curved face 31 creating a slot 32 where the tray back 35 slides into. The shape of the curving slot 32 enables pressure to be applied to the inner surface of the tray back 35 by the thicker ends 33 of the flange 30. Pressure on the outer surface of the tray back 35 is applied in the opposite direction by the curved face 31, thus holding the tray 25 in a pinched condition. As a further aid in securing the tray 25, a support lip 34 keeps the tray 25 from slipping down out of the slot 32. By holding the tray 25 by the tray back 35, it is quite easy to slide the tray 25 into and out of the bracket 26 with only one hand, without any interaction with other mechanisms or secondary operations.

Another accessory which may be added to the tilting and rotating puzzle table is a storage cover (not shown) which may be securely placed over a partially completed puzzle to protect it from disturbance by people or pets, and to make it possible to secure a partially completed puzzle on the tabletop in a vertical position for temporary storage.

What is claimed is:

1. A jigsaw puzzle table comprising;

a tabletop having a rotation means, a tilt means, and a support means;

wherein;

the tabletop consists of a surface board having a flat surface and a surface cover adhesively attached to said surface board and having a frictional aspect which prevents puzzle pieces from sliding;

the rotation means consisting of a swiveling mechanism centrally located and fixably attached to the underside of the tabletop such that table user may rotate the tabletop horizontally left or right, clockwise or counter-clockwise, as desired;

the swiveling mechanism may be mounted to a sub-table member which facilitates the interface between the rotation means and the tilt means;

the tilt means consists of a pivoting mechanism enabling the tabletop to tilt downward nearest the table user in graduated increments to a desired position;

the pivoting mechanism is mounted to the underside of the rotation means or to the underside of the sub-table member;

the pivoting mechanism pivots on a horizontal axis perpendicular to a line from the center of the tabletop to the user;

the pivoting mechanism includes a control mechanism enabling the table user to secure the tabletop in the desired position;

the support means is mounted to the underside of the pivoting mechanism and consists of at least one support column for supporting the tabletop relative to the floor;

the at least one support column has a length-changeable adjustment mechanism installed therein and is attached to the pivoting mechanism;

the adjustment mechanism has a control mechanism to change the length of the support column, thus adjusting the height of the tabletop from the floor;

the control mechanism has an operation handle and connection means to enable the length-changeable adjustment mechanism to be changed, thus changing the height of the tabletop;

the at least one support column is mounted to and supported by a base frame with at least three rolling mechanisms.

2. A jigsaw puzzle table as claimed in claim 1 wherein;

the sub-table comprises a board member having two flat surfaces and sufficient thickness to provide structural stability for the tabletop;

the board member provides structural stability to connect the rotation means with the tilt means;

the board member has attachment means on its upper surface to enable the mounting of the rotation means and attachment means on its lower surface to enable the mounting of the tilt means;

the board member is of sufficient dimensions to provide a mounting position for the control mechanism operation handle;

the board member is of sufficient dimension and strength to provide a mounting position for an accessory bracket;

the accessory bracket consists of a rigid surface with holes for the attachment of accessories desired by the puzzle assembler to enhance the putting together of the puzzle.

3. A jigsaw puzzle table comprising;

a tabletop having a tilt means, and a support means;

wherein;

the tabletop consists of a surface board having a flat surface and a surface cover adhesively attached to said surface board and having a frictional aspect which prevents puzzle pieces from sliding;

the tilt means consists of a pivoting mechanism enabling the tabletop to tilt downward nearest the table user in graduated increments to a desired position;

the pivoting mechanism pivots on a horizontal axis perpendicular to a line from the center of the tabletop to the user;

the pivoting mechanism includes a control mechanism enabling the table user to secure the tabletop in the desired position;

the support means is mounted to the underside of the pivoting mechanism and consists of at least one support column for supporting the tabletop relative to the floor;

the at least one support column has a length-changeable adjustment mechanism installed therein and is attached to the pivoting mechanism;

the adjustment mechanism has a control mechanism to change the length of the support column, thus adjusting the height of the tabletop from the floor;

the at least one support column can be extended to a length capable of supporting the tabletop to a height appropriate for the user to stand;

the control mechanism has an operation handle and connection means to enable the length-changeable adjustment mechanism to be changed, thus changing the height of the tabletop;

the at least one support column is mounted to and supported by a base frame with at least three rolling mechanisms.

4. A jigsaw puzzle tray and support apparatus comprising;

at least one detachable tray member, a support member, and at least one compatible connecting member;

wherein;

the at least one detachable tray member has a flat bottom with four side members extending upward;

the four side members having three side members extending upward at an angle approaching closely to or reaching vertical, and one side member extending upward at an angle approaching horizontal;

the one side member extending upward at an angle approaching horizontal is configured such that the puzzle pieces stored in the tray may be easily slid out from the tray to the puzzling surface without having to pick up the pieces individually;

the at least one detachable tray member is made of a material which is sufficiently flexible to bend slightly when being detached and reattached to the compatible connecting member;

the material of the tray member may be paper, plastic, metal, or wood;

the compatible connecting member is a bracket having a curved slot wide enough to slidably receive one of the three side members of the detachable tray;

the curved slot is formed by a convexly curved back and a juxtaposed concavely curved flange front;

the curved slot of the bracket is configured such that the center of the convexly curved back puts pressure on one surface of a detachable tray side member and the two outer edges of the flange put pressure on the opposite surface of the detachable tray side member, thus pinching the tray side member and holding the detachable tray in place without requiring a secondary movable holding mechanism to secure the detachable tray in place;

the curved slot may have a secondary curve perpendicular to the plane of the original curved slot;

the bracket further includes a bottom lip to ensure the detachable tray stays in place;

the compatible connecting member bracket is capable of being combined into a multiple bracket unit to hold more than one detachable tray;

the support member of the jigsaw puzzle tray and support apparatus mounts on the accessory bracket of the board member of the sub-table of the jigsaw puzzle table of claim 1;

the support member may be flexible such that it can be modified to position the tray members in a horizontal position;

the support member may be rigid such that the jigsaw puzzle tray apparatus stands stably on a horizontal surface without being attached to an accessory bracket.

* * * * *